US010092124B1

(12) United States Patent
Tsai

(10) Patent No.: US 10,092,124 B1
(45) Date of Patent: Oct. 9, 2018

(54) PRE-LIT METAL FRAME CHRISTMAS TREE

(71) Applicant: Raymond Tsai, Taipei (TW)

(72) Inventor: Raymond Tsai, Taipei (TW)

( * ) Notice: Subject to any disclaimer, the term of this patent is extended or adjusted under 35 U.S.C. 154(b) by 0 days.

(21) Appl. No.: 15/687,434

(22) Filed: Aug. 25, 2017

(51) Int. Cl.

| | |
|---|---|
| ***A47G 33/06*** | (2006.01) |
| ***A47G 33/08*** | (2006.01) |
| ***F21S 4/15*** | (2016.01) |
| ***F21V 21/08*** | (2006.01) |
| ***F21V 21/008*** | (2006.01) |
| *F21W 121/04* | (2006.01) |

(52) U.S. Cl.
CPC ..... *A47G 33/06* (2013.01); *A47G 33/08* (2013.01); *F21S 4/15* (2016.01); *F21V 21/008* (2013.01); *F21V 21/0816* (2013.01); *A47G 2033/0827* (2013.01); *F21W 2121/04* (2013.01)

(58) Field of Classification Search
USPC ..... 362/123
See application file for complete search history.

(56) References Cited

U.S. PATENT DOCUMENTS 5,094,893 A * 3/1992 Snider ..... A47G 33/06 211/205
5,488,549 A * 1/1996 Miller ..... A01G 5/04 211/195

* cited by examiner

*Primary Examiner* — Rafferty Kelly
(74) *Attorney, Agent, or Firm* — Hershkovitz & Associates, PLLC; Abe Hershkovitz

(57) ABSTRACT

A pre-lit metal frame Christmas tree has a foot prod, an umbrella-shaped net light, and multiple metal stakes. The umbrella-shaped net light is mounted on the foot prod and has an umbrella shaped frame and a light string unit. Umbrella shaped frame is mounted on the foot prod and has a base, a trunk, multiple positioning rods, and an upper fixing unit. Base is mounted on the foot prod, the trunk is mounted on the base and extends upwardly. The positioning rods are mounted transversely and pivotally on the base, arranged apart from each other. The fixing rings are mounted respectively on the positioning rods. The upper fixing unit is mounted on a top of the trunk. Light string unit is mounted on the umbrella shaped frame. The metal stakes are respectively mounted through the fixing rings, inserted into the ground. The Christmas tree is easy for assembly and storage.

11 Claims, 18 Drawing Sheets

PRE-LIT METAL FRAME CHRISTMAS TREE

BACKGROUND OF THE INVENTION

1. Field of the Invention

The present invention relates to a pre-lit metal frame Christmas tree, especially to a pre-lit metal frame Christmas tree that can be easily and efficiently assembled through metal stakes.

2. Description of the Prior Arts

To attract the consumers and promote their interest in purchasing the metal frame Christmas trees, the manufacturers, besides adding variations to the appearances of the conventional pre-lit metal frame Christmas trees, also endeavor to lower the retail price of the pre-lit metal frame Christmas tree. For economy in transportation, reduction of material and packaged size of the pre-lit metal frame christmas tree is one of the key factors to lower the retail price. Therefore, the manufacturers tend to dismantle the pre-lit metal frame christmas trees when displayed for sale and leave them to the consumers to assemble on their own.

However, to further reduce the volume of the packed conventional pre-lit metal frame christmas tree, usually the manufacturers will dismantle the ring shaped supporting frame of the Christmas tree into multiple arc shaped metal pieces. But the lighting strings of the Christmas tree are mounted securely on the ring shaped supporting frame beforehand, which means when the ring shaped supporting frame is dismantled into multiple arc shaped metal pieces, the lighting strings are bound to be bent, tangled or even damaged. The lighting strings which are tangled with the arc shaped metal pieces or other lighting strings make the assembly procedure more complicated and time consuming for the consumers.

To overcome the shortcomings, the present invention provides a pre-lit metal frame Christmas tree to mitigate or obviate the aforementioned problems.

SUMMARY OF THE INVENTION

The main objective of the present invention is to provide a pre-lit metal frame Christmas tree that is not only small in volume for storage but also easy to assemble. Specifically, to assemble the Christmas tree, users only need to mount the umbrella-shaped net light on the foot prod, unfold the umbrella-shaped net light, and then fix the Christmas tree by the metal stakes. The pre-lit metal frame Christmas tree has a foot prod, an umbrella-shaped net light, and multiple metal stakes. The umbrella-shaped net light is mounted on the foot prod and comprises an umbrella shaped frame and a light string unit. The umbrella shaped frame comprises a base, a trunk, multiple positioning rods, multiple fixing rings, and an upper fixing unit. The umbrella shaped frame is mounted on the foot prod, the trunk is mounted on the base and extends upwardly, the multiple positioning rods are transversely and pivotally connected to the base and arranged apart from each other, the fixing rings are each respectively mounted on an end of a respective one of the positioning rods, and the upper fixing unit is mounted on a top of the trunk. A top of the light string unit is annularly mounted on a top of the upper fixing unit, and a bottom of the light string unit is mounted on the multiple fixing rings. The multiple metal stakes are respectively mounted through the fixing rings and fix the positioning rods.

Given the forgoing structure of the pre-lit metal frame Christmas tree, during assembly of the Christmas tree, because most of the components are mounted together beforehand, the users only need to put the foot prod to the determined place, mount the umbrella-shaped net light on the foot prod, unfold the umbrella-shaped net light, and then mount the metal stakes through the corresponding fixing ring, after which the assembling procedure is completed. Thus, by omitting the components that require complicated assembling procedures, the structure of the present invention simplifies the assembling procedure.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
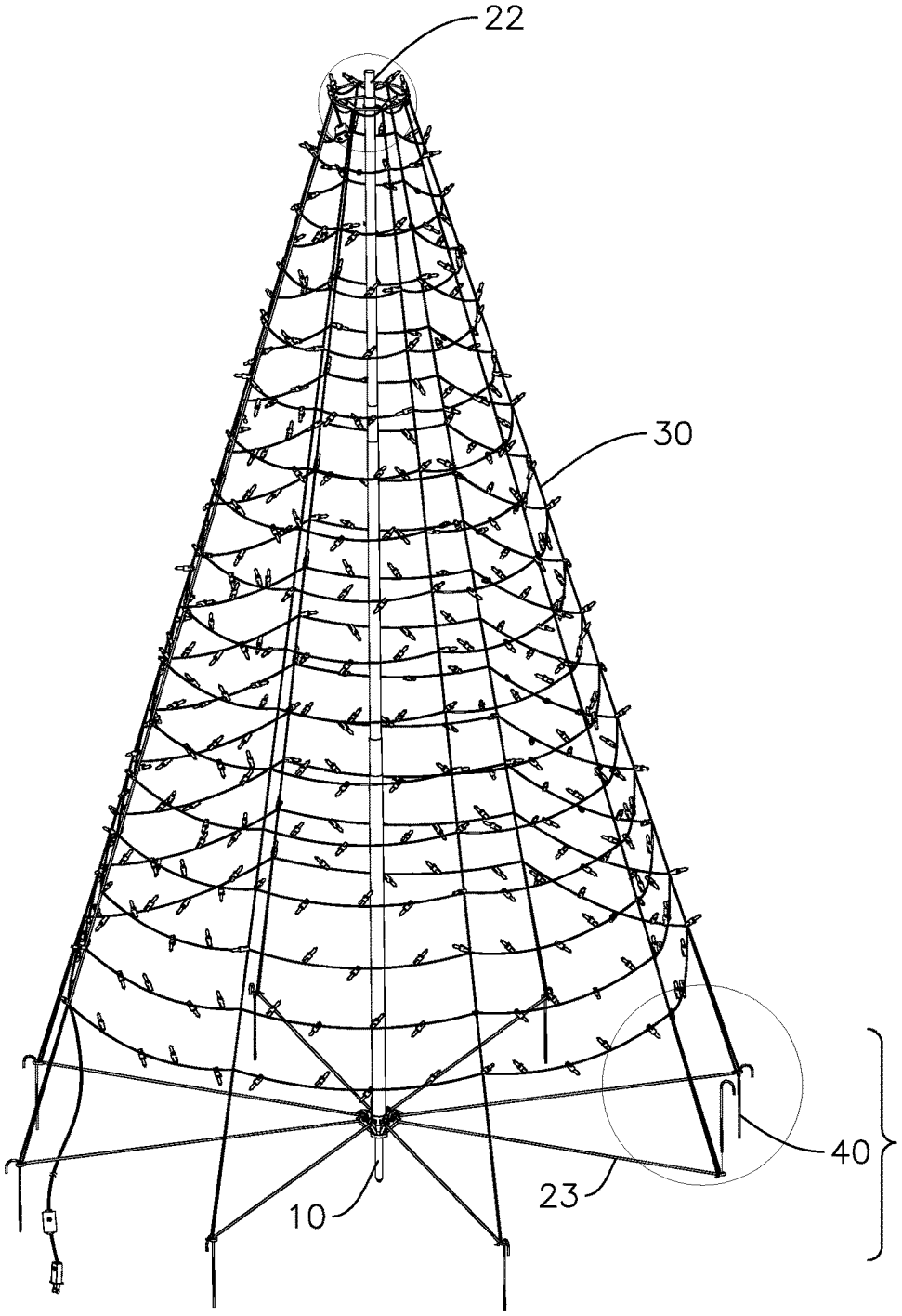
FIG. 1 is a perspective view of a first embodiment of the pre-lit metal frame Christmas tree in accordance with the present invention.
Figure 5:
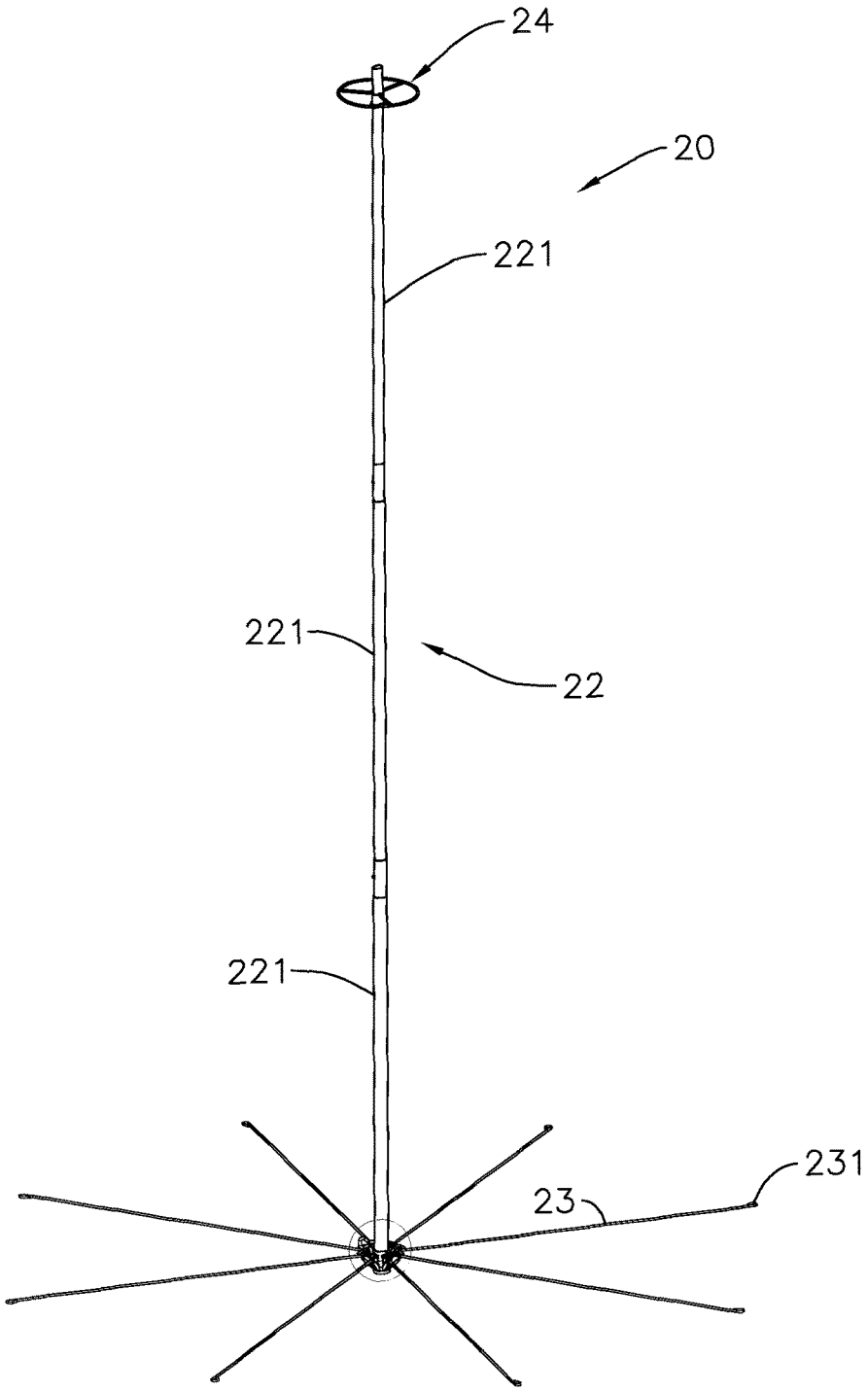
FIG. 5 is a perspective view of the umbrella shaped frame of the pre-lit metal frame Christmas tree in FIG. 1 in the unfolded status.
Figure 8:
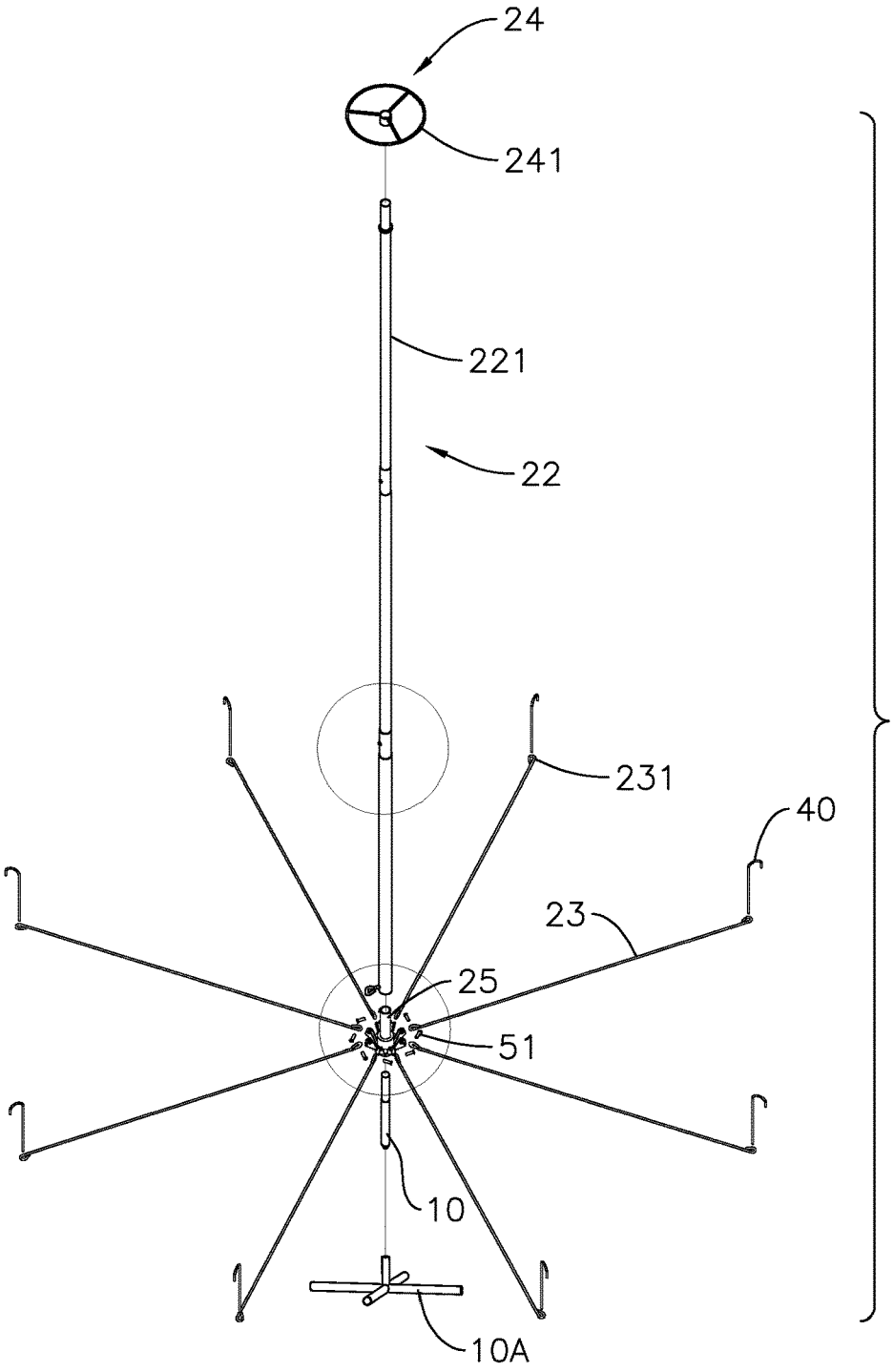
FIG. 8 is an exploded perspective view of the umbrella shaped frame and the foot prod and the foot stand, two different embodiments of the present invention.

With reference to FIGS. 1, 5 and 8, a pre-lit metal frame Christmas tree in accordance with the present invention comprises a foot prod 10, an umbrella-shaped net light, and multiple metal stakes 40.

Figure 4:
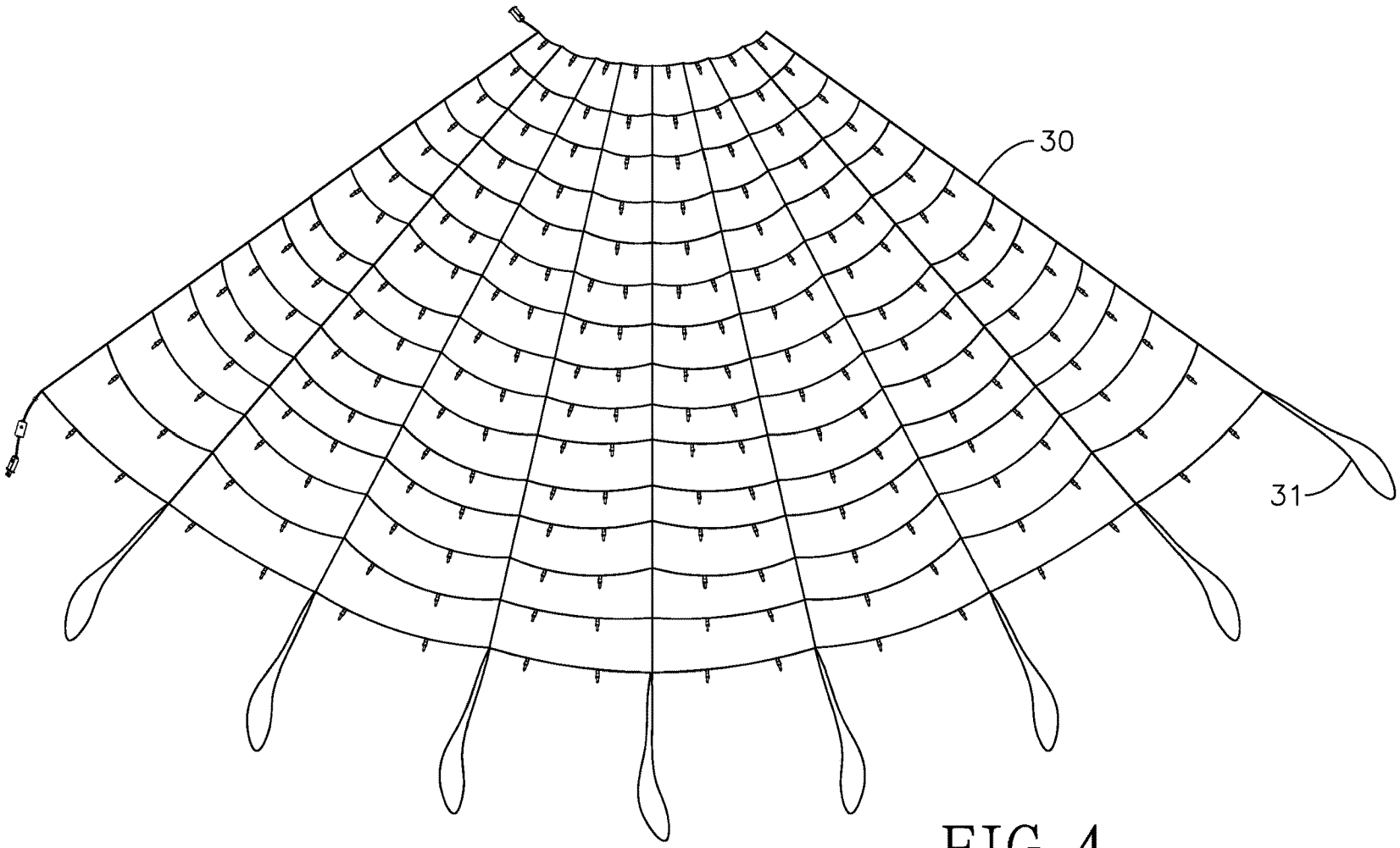
FIG. 4 is a front view of the light string unit of the pre-lit metal frame Christmas tree in FIG. 1.

With reference to FIGS. 1, 4 and 5, the umbrella-shaped net light comprises an umbrella shaped frame 20 and a light string unit 30.

Figure 11:
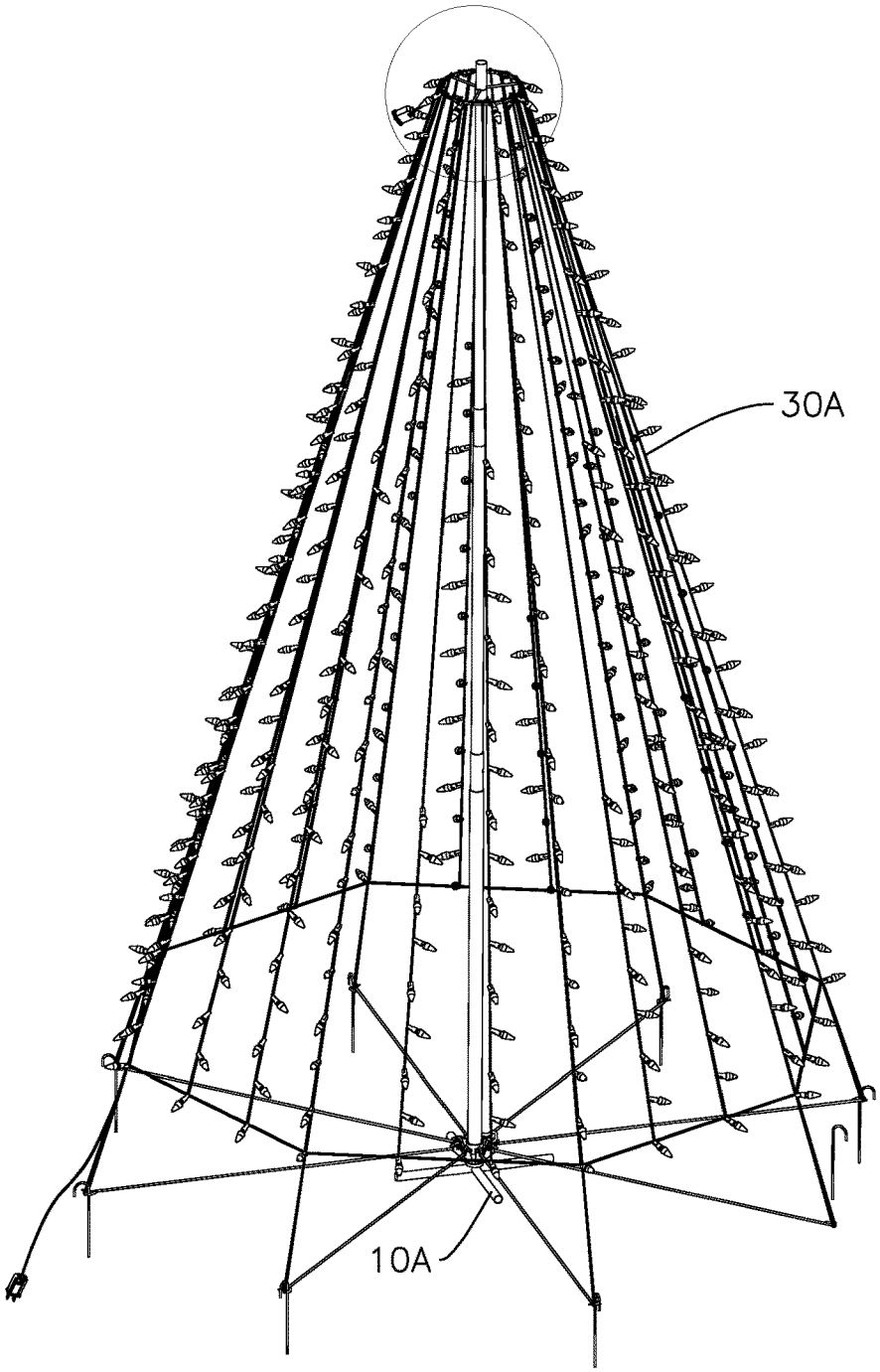
FIG. 11 is a perspective view of the pre-lit metal frame Christmas tree in accordance with another embodiment of the present invention.
Figure 12:
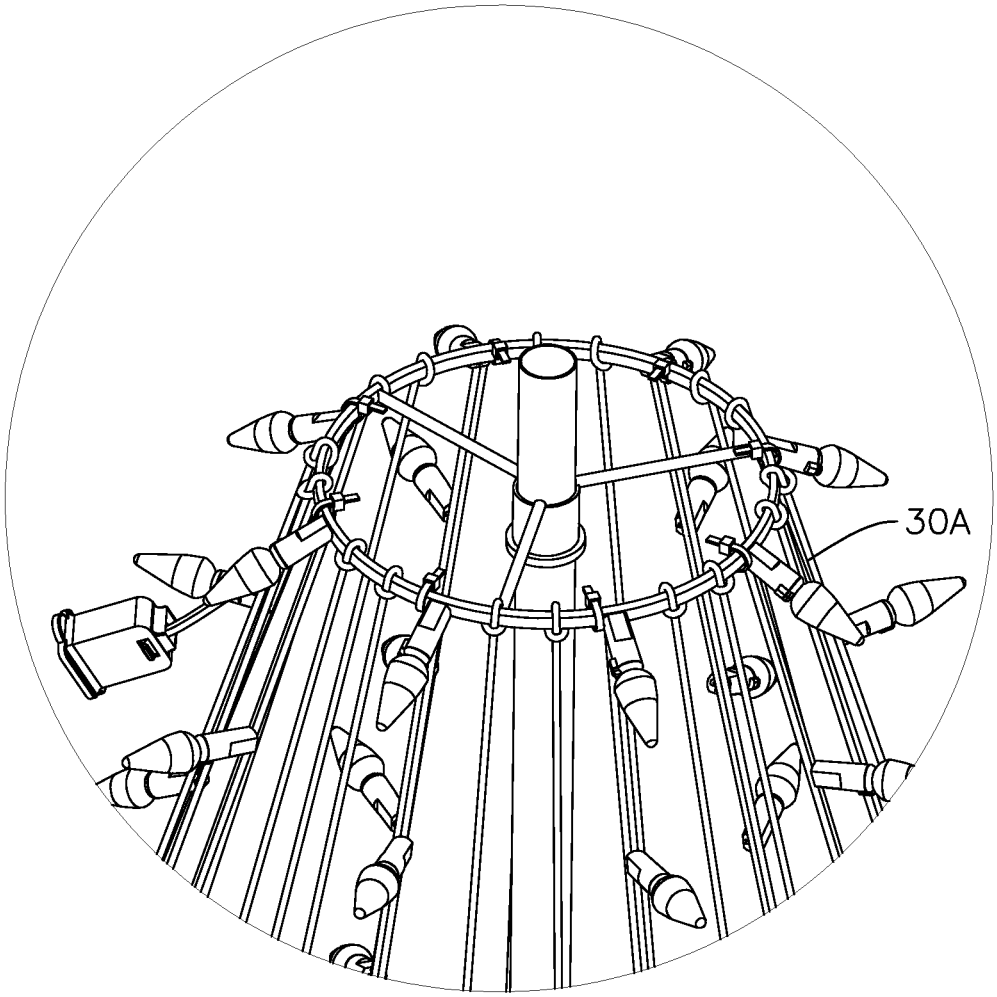
FIG. 12 is a top enlarged perspective view of the pre-lit metal frame Christmas tree in FIG. 11.

With reference to FIGS. 1, 8 and 11, in a main embodiment of the present invention, the foot prod 10 is a ground insert to be inserted into the ground to position the pre-lit metal frame Christmas tree. In another embodiment, the foot prod can be replace by a foot stand 10A, supporting the pre-lit metal frame Christmas tree to stand on the ground. The foot prod 10 and foot stand 10A in the present invention are interchangeable upon demand.

Figure 7:
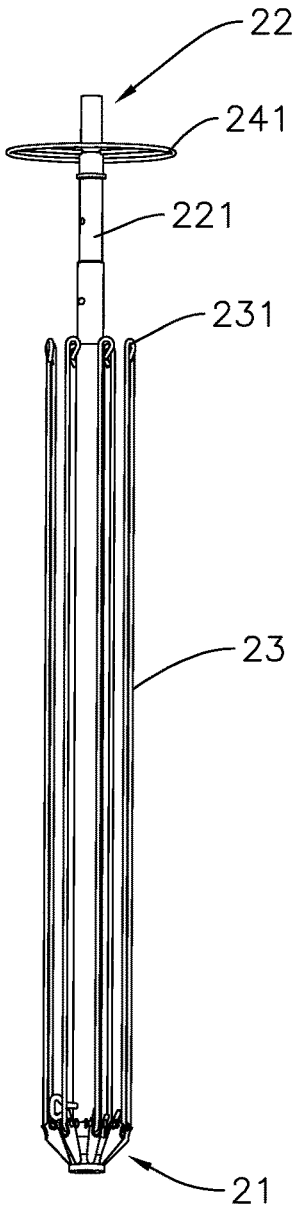
FIG. 7 is a perspective view of the umbrella shaped frame of the pre-lit metal frame Christmas tree in FIG. 5 in the folded status.

With reference to FIGS. 5, 7 and 8, the umbrella shaped frame 20 is mounted on the foot prod 10 and has a base 21, a trunk 22, multiple positioning rods 23, an upper fixing unit 24 and a connecting tube 25.

Figure 6:
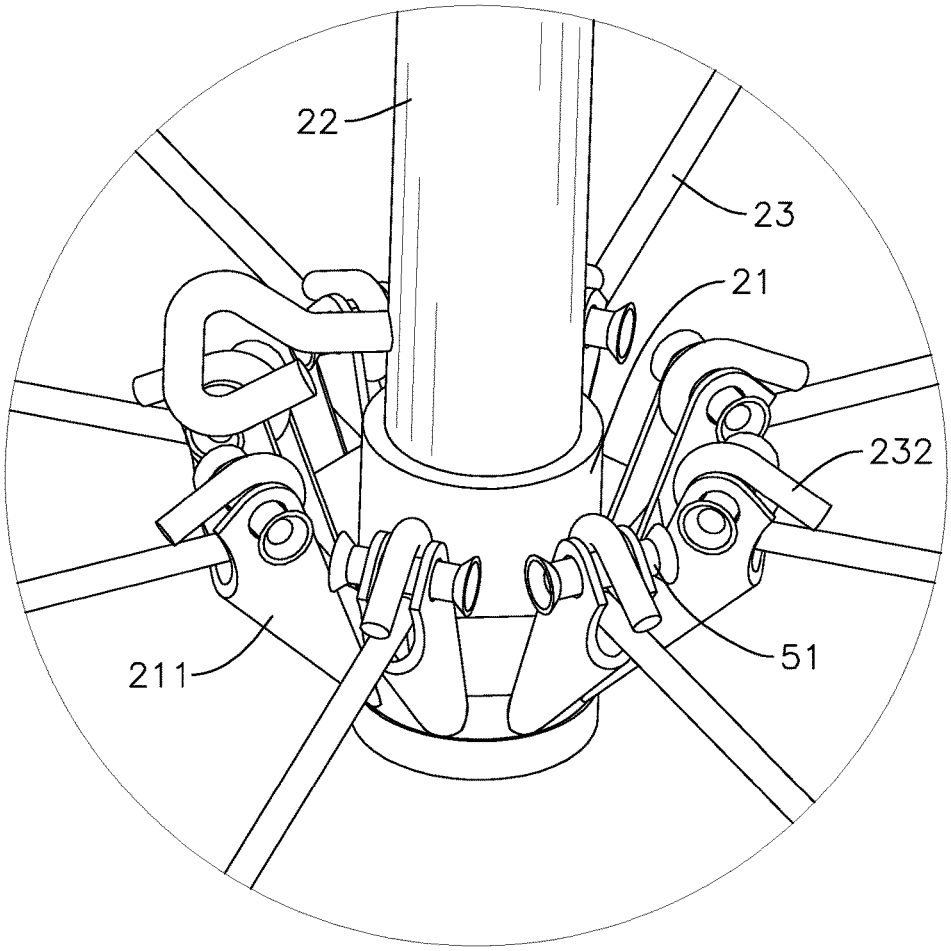
FIG. 6 is an enlarged perspective view of the base of the pre-lit metal frame Christmas tree in FIG. 1.

With reference to FIG. 6, the base 21 is mounted on the foot prod 10 and further comprises multiple positioning units 211, the positioning units 211 are mounted annularly on the base 21 and are arranged apart from each other. In the main embodiment, the positioning units 211 are arranged apart from each other at equiangular intervals, but it is not limited thereto.

With reference to FIGS. 5, 7 and 8, the trunk 22 is mounted on the base 21 and extends upwardly. Specifically, in the main embodiment of the present invention, the trunk 22 comprises multiple supporting tubes 221 that are, but not limited to, cylindrical tubes, i.e., the supporting tubes 221 may be tubes in any other shape.

Figure 9:
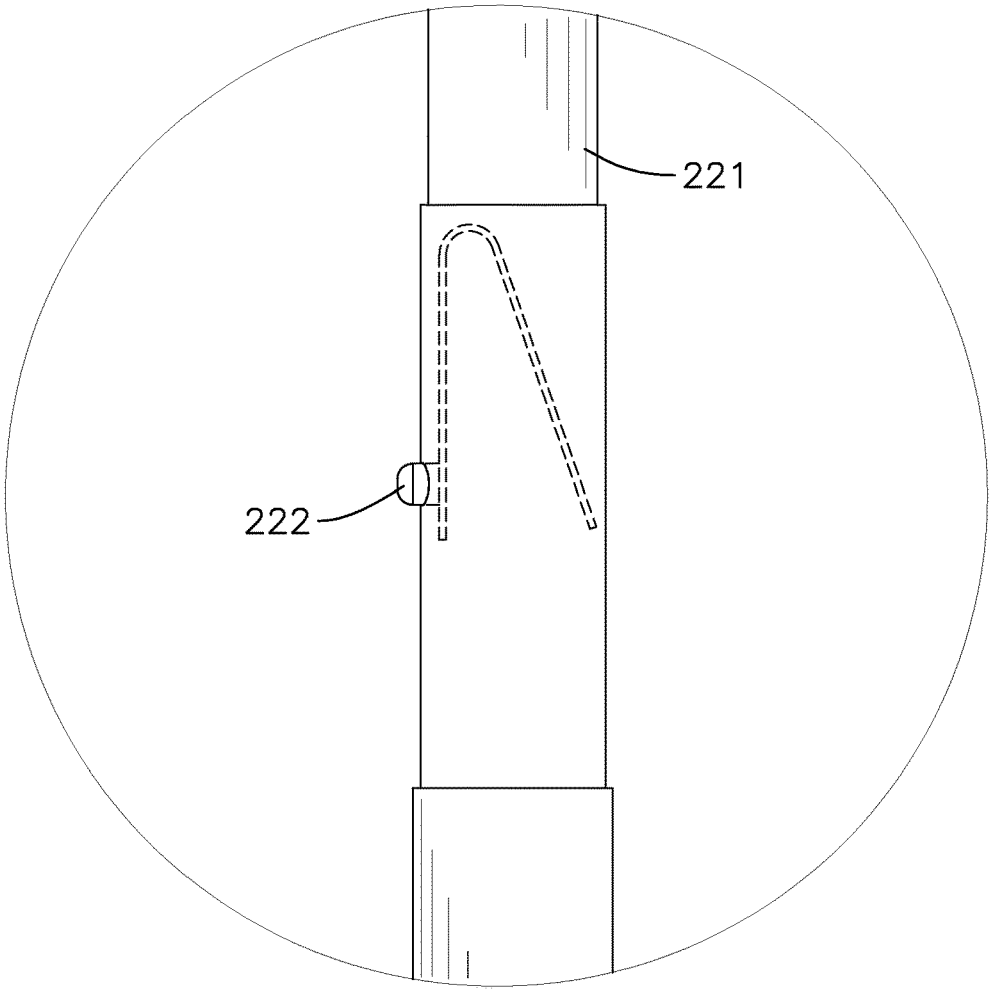
FIG. 9 is an enlarged front view of the elastic engaging unit of the pre-lit metal frame Christmas tree in FIG. 8.

The supporting tubes 221 are sleeved around each other in sequence, and each two adjacent ones of the supporting tubes 221 are mutually slidable and are selectively mounted securely with each other by an elastic engaging unit 222, as shown in FIG. 9.

With reference to FIG. 14 to FIG. 17, in another embodiment of the present invention, the trunk 22A comprises multiple supporting tubes 221A that are cylindrical tubes. Each one of the supporting tubes 221A has a large diameter end and a small diameter end, and two adjacent supporting tubes 221A are sleeved with each other in a way that the large diameter end of one of the two supporting tubes 221A is mounted around the small diameter end of the other supporting tube 221A. Moreover, the annular fixing stand 241A is sleeved with an end of the top supporting tube 221A.

With reference to FIGS. 5, 6, 8 and 10, the positioning rods 23 are transversely and pivotally connected to the base 21. In the main embodiment of the present invention, the positioning rods 23 are arranged at equiangular intervals, but it is not limited thereto; multiple fixing rings 231 are each respectively mounted on an end of a respective one of the positioning rods 23, a pivoting ring 232 is mounted on the other ends of the positioning rods 23, specifically, the positioning rods 23 are pivotally connected with the positioning units 211 respectively by the pivoting ring 232, multiple rivets 51 are respectively mounted through the positioning units 211 and the corresponding pivoting rings 232 as a pivot, but it is not limited thereto, and the pivot may also be any other structure rather than the rivet 51.

With reference to FIG. 5 and FIG. 7, in the main embodiment of the present invention, between each one of the positioning rods 23 and the trunk 22, the pivot angle ranges from 0 degree to 100 degrees (including 0 degree and 100 degrees), but the range is not limited thereto, and the pivot angle may be in any other range.

Figure 2:
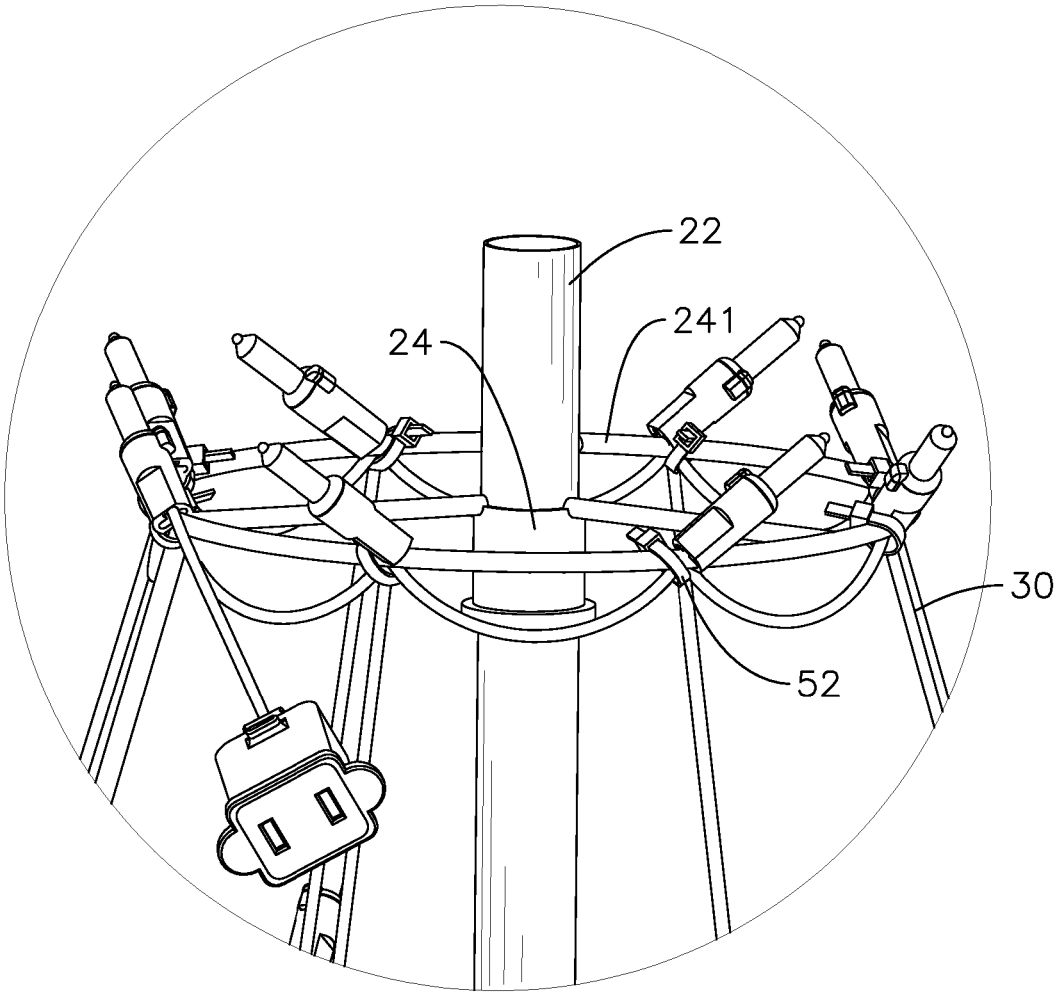
FIG. 2 is an enlarged perspective view of the upper fixing unit of the pre-lit metal frame Christmas tree in FIG. 1.

With reference to FIG. 2 and FIG. 8, the upper fixing unit 24 is mounted around a top of the trunk 22, the upper fixing unit 24 further comprises an annular fixing stand 241, and the annular fixing stand 241 extends annularly on a periphery of the upper fixing unit 24.

Figure 10:
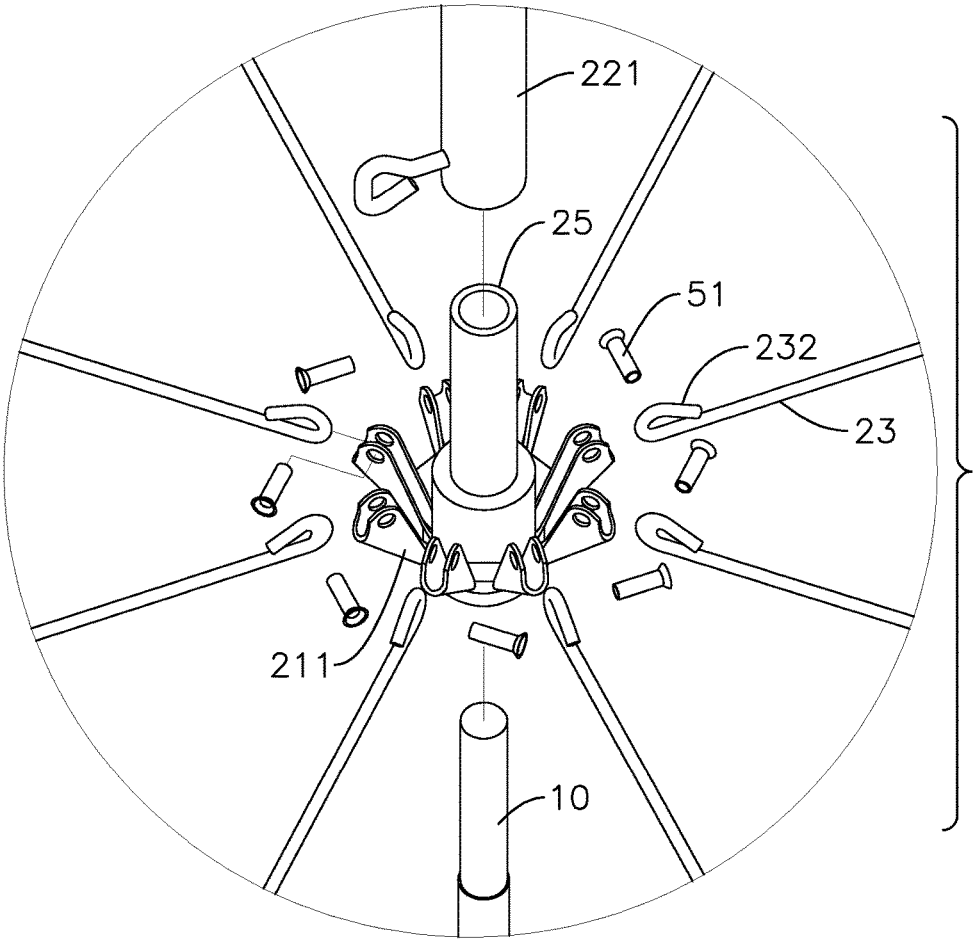
FIG. 10 is an enlarged and exploded perspective view of the base in FIG. 8.

With reference to FIG. 8 and FIG. 10, the connecting tube 25 is mounted on the base 21 and extends upwardly from the base 21. A bottom of the trunk 22 is mounted around the connecting tube 25.

With reference to FIGS. 1, 2, 3 and 4, a top of the light string unit 30 is mounted annularly on the upper fixing unit 24 of the umbrella shaped frame 20, and specifically, the light string unit 30 is mounted annularly on the annular fixing stand 241. Multiple fixing ropes 31 are mounted on a bottom of the light string unit 30, and the multiple fixing ropes 31 are also respectively mounted with the multiple fixing rings 231 of the positioning rods 23.

Figure 13:
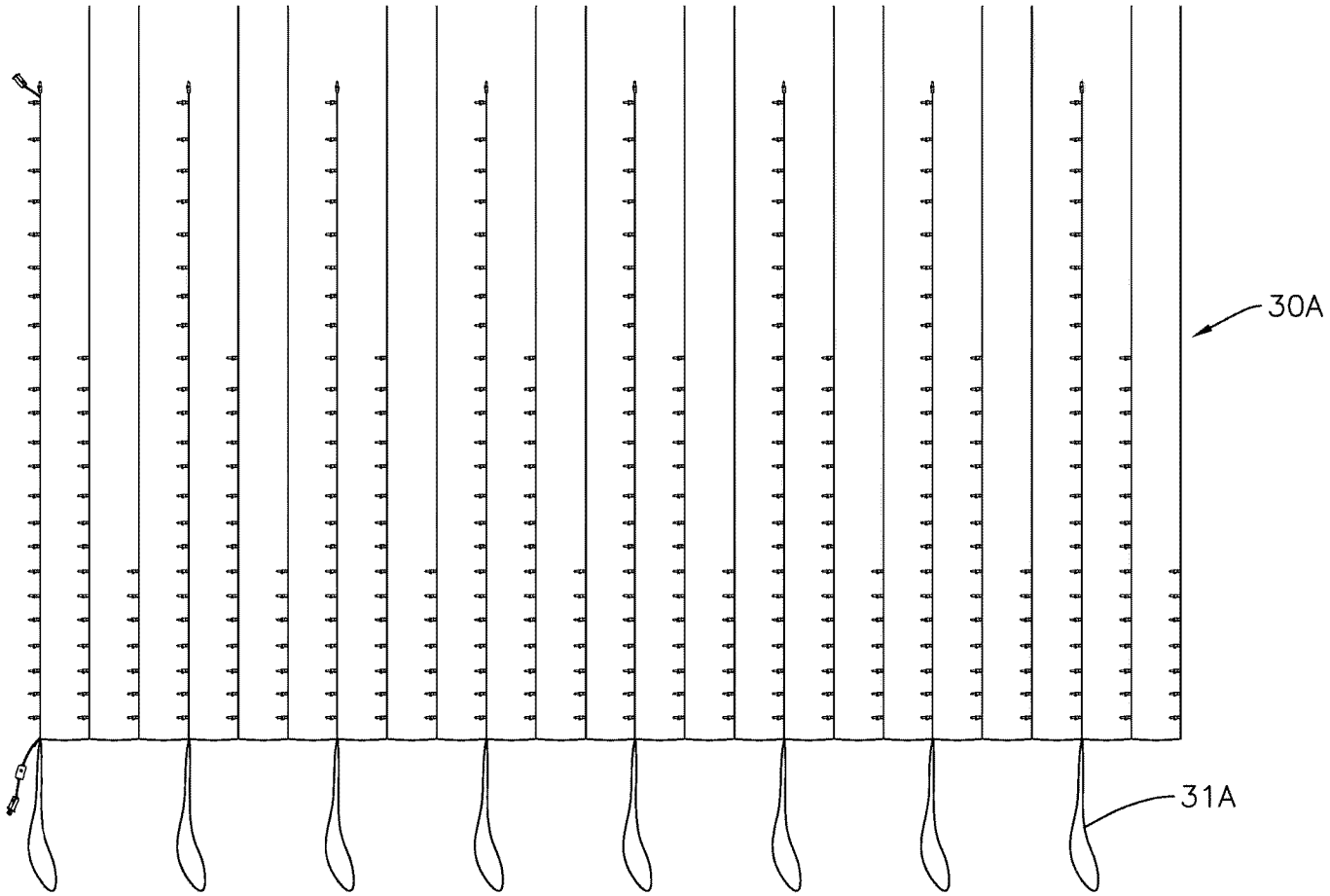
FIG. 13 is a front view of the light string unit in accordance with said another embodiment of the present invention.
Figure 14:
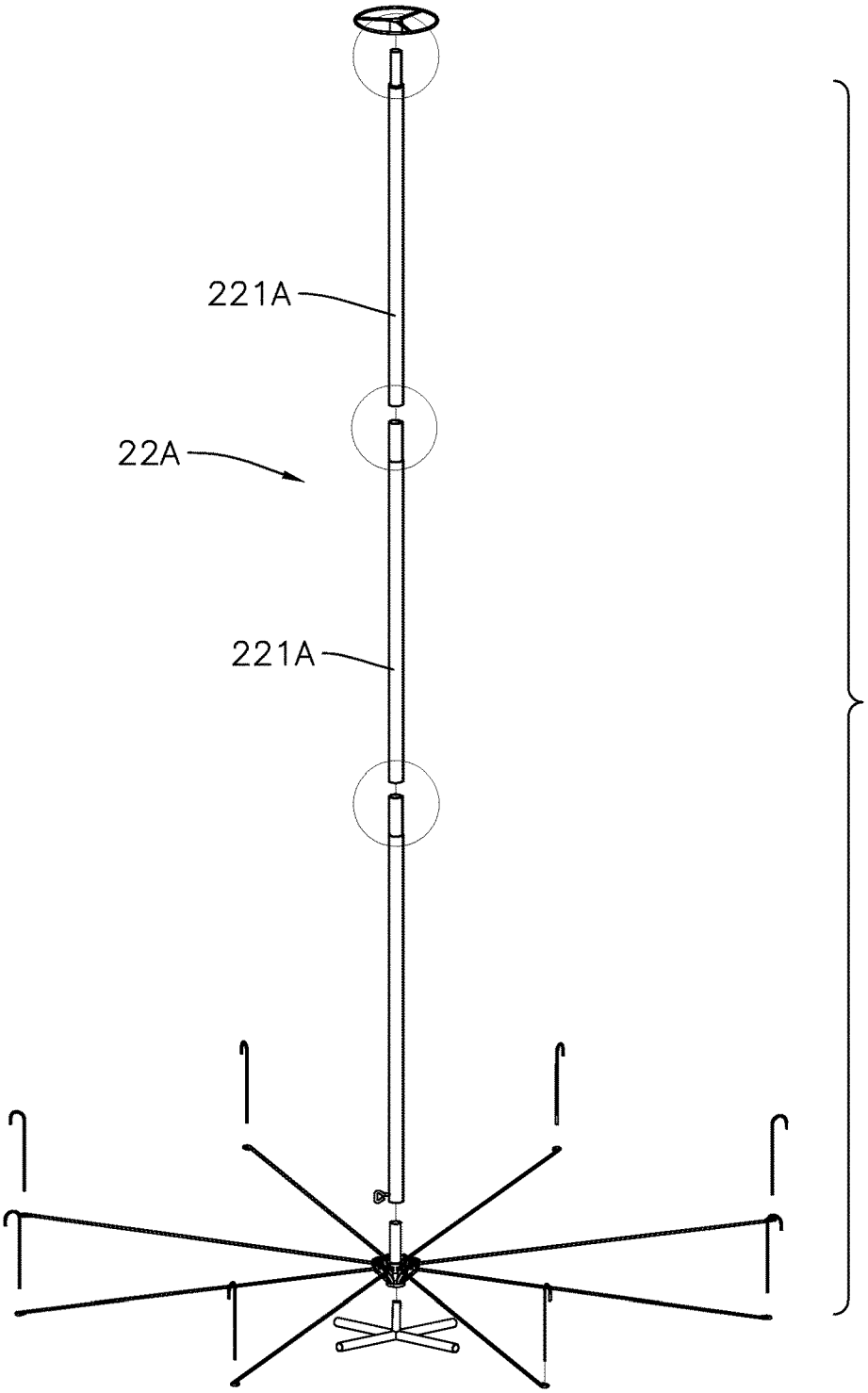
FIG. 14 is an exploded perspective view of the trunk in accordance with said another embodiment of the present invention.
Figure 15:
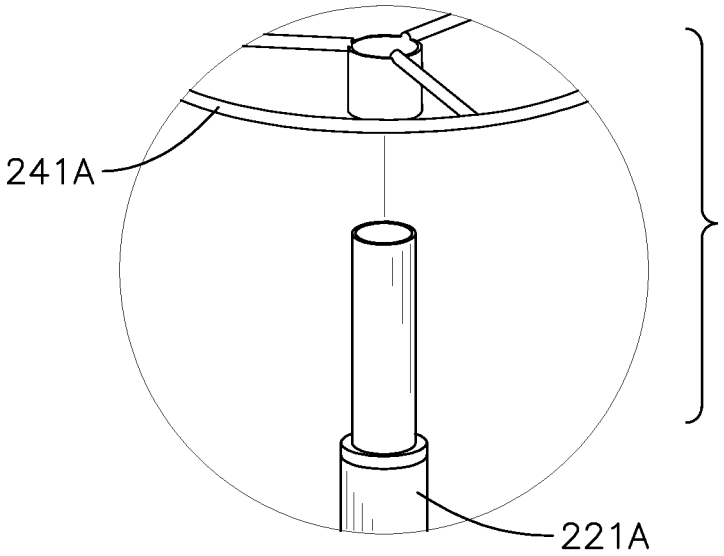
FIG. 15 is an enlarged perspective view of the supporting tubes in FIG. 14.
Figure 16:
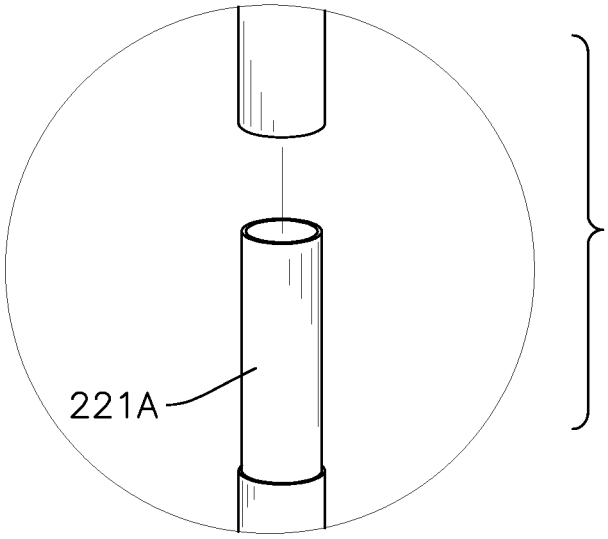
FIG. 16 is another enlarged perspective view of the supporting tubes in FIG. 14.
Figure 17:
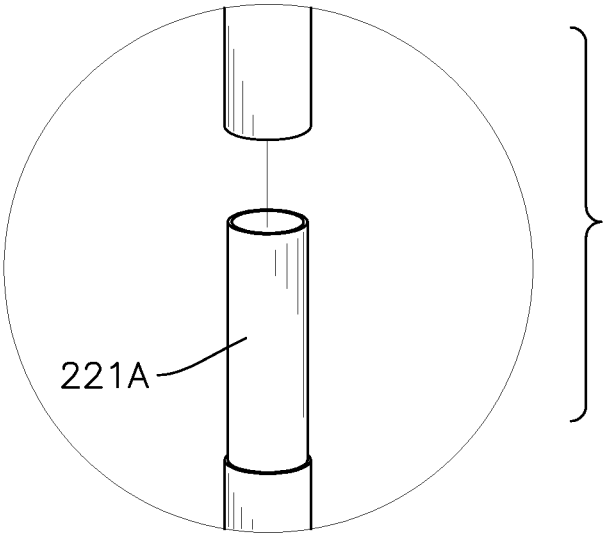
FIG. 17 is still another enlarged perspective view of the supporting tubes in FIG. 14.

With reference to FIG. 2 and FIG. 13, in the main embodiment of the present invention, the top of the light string unit 30 is mounted on the annular fixing stand 241 of the upper fixing unit 24 by multiple cable ties 52, and the bottom of the light string unit 30 is annularly mounted on the positioning rods 23 by disposing the multiple fixing ropes 31 through the respective fixing rings 231 and mounting the fixing ropes 31 with the fixing rings 231 by the cable ties 52, but it is not limited to, as the top and the bottom of the light string unit 30 may be mounted with the umbrella shaped frame 20 in different ways. For example, by tying up the top and the bottom of the light string unit 30 with the umbrella shaped frame 20.

Figure 18:
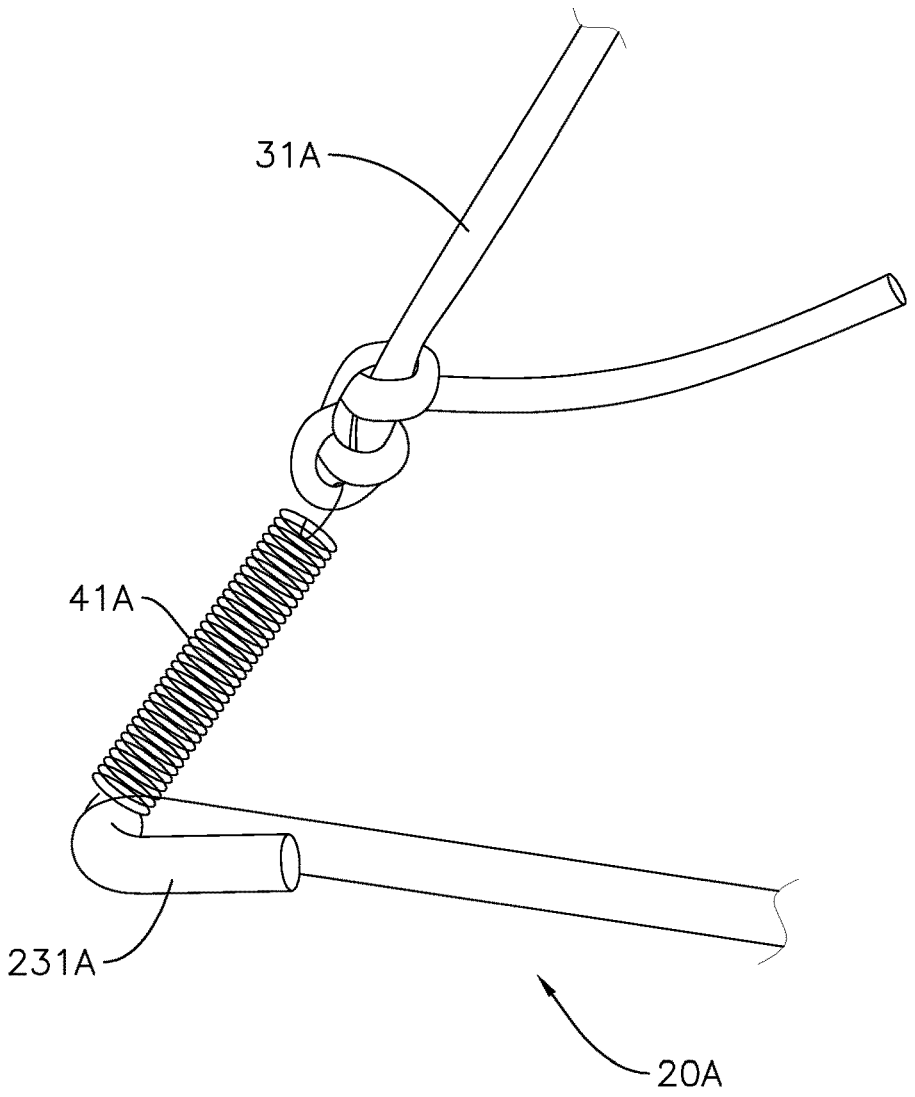
FIG. 18 is an enlarged perspective view of the light string unit and the fixing ring in accordance with said another embodiment of the present invention.

With reference to FIG. 18, in another embodiment of the present invention, multiple resilient elements 41A are mounted between a bottom of the light string unit 30A and the corresponding fixing rings 231A of the umbrella shaped frame 20A, the two ends of each one of the resilient elements 41A are respectively mounted with the bottom of the light string unit 30A and the corresponding fixing ring 231A. The resilient elements 41A allow the light string unit 30A to be stretched relative to the fixing rings 231A.

With reference to FIG. 4, in the main embodiment of the present invention, the light string unit 30 is a net lights, and in another embodiment of the present invention, the light string unit 30A is a curtain light string, as shown in FIG. 11, but the light string unit 30 may be of any other structure.

The type of the light source mounted on the light string unit 30 is adjustable, and a preferred type of the light source is, but not limited to, incandescent lights or light emitting diode (LED) lights.

The amount of the light string unit 30 is adjustable. For example, when the corresponding umbrella shaped frame 20 is large in size, multiple light string units 30 may be mounted on the umbrella shaped frame 20.

Figure 3:
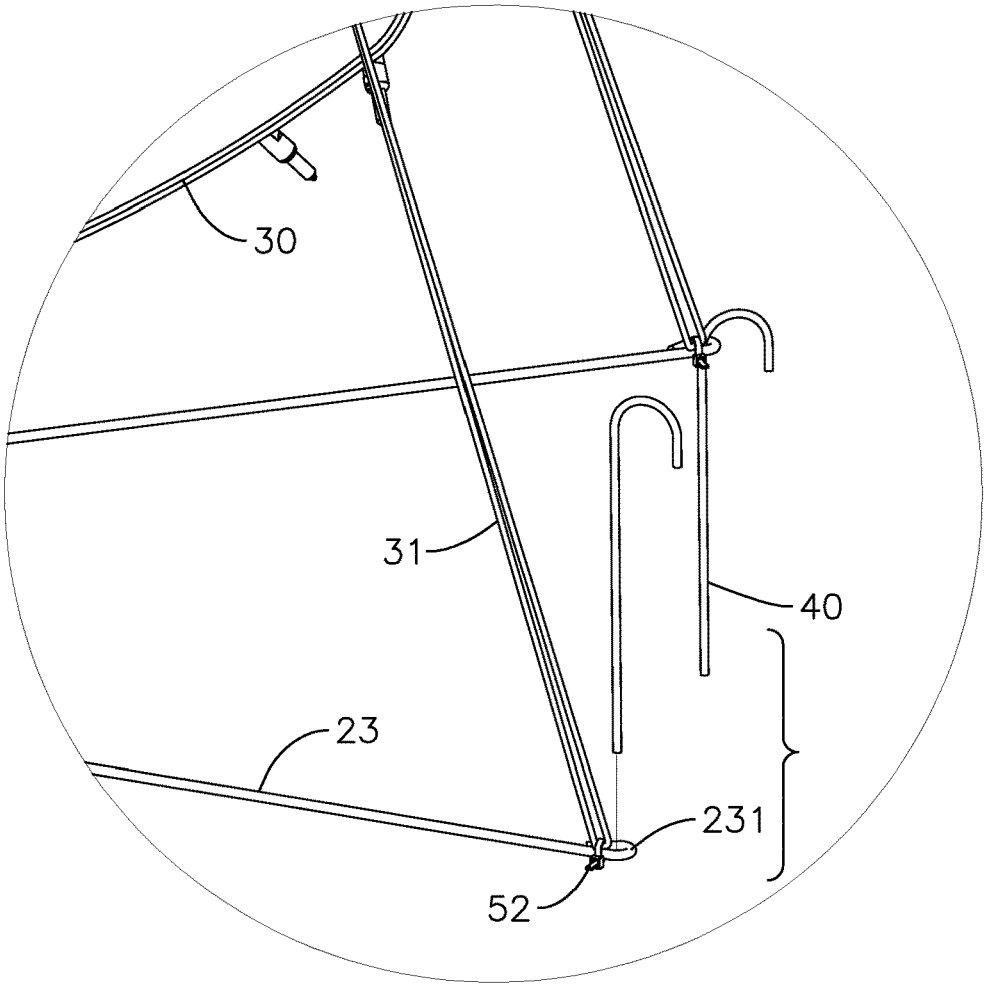
FIG. 3 is an enlarged perspective view of the metal stakes of the pre-lit metal frame Christmas tree in FIG. 1.

With reference to FIGS. 1, 3 and 8, the multiple metal stakes 40 are mounted through the corresponding fixing rings 231 of the positioning rods 23. By inserting the metal stakes 40 into the ground, the metal stakes 40 are able to securely position the umbrella shaped frame 20.

With reference to FIGS. 3, 6 and 7, the present invention comprises fewer components and has easier assembling procedures; it is obviously more convenient with the umbrella shaped frame 20 that has a large volume. When assembling the pre-lit metal frame Christmas tree, users first rotate the positioning rods 23 relative to the base 21, unfold the umbrella shaped frame 20 from a folded status, as shown in FIG. 7 and FIG. 8, and then upwardly extend the trunk 22, because the light string unit 30 is mounted on the umbrella shaped frame 20 beforehand, when the positioning rods 23 are rotated and the trunk 22 is extended, the pre-lit metal frame Christmas tree is then constructed, and the only step left is to insert the metal stakes 40 into the ground, thereby accomplishing the assembling procedure of the pre-lit metal frame Christmas tree.

With reference to FIG. 7, for storage, the umbrella-like structure efficiently reduces the volume of the present invention. Furthermore, because the positioning rods 23 can be folded, there is no need to dismantle the positioning rods 23 when packing the umbrella shaped frame 20, which means that the light string unit 30 is less likely to be bent or tangled with other components, and thus the light string unit 30 is well preserved during the folded procedure of the present invention.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pre-lit metal frame Christmas tree comprising:
- a foot prod;
- an umbrella-shaped net light mounted on the foot prod and having:
  - an umbrella shaped frame mounted on the foot prod and having
    - a base mounted on the foot prod;
    - a trunk mounted on the base and extending upwardly;
    - multiple positioning rods transversely and pivotally connected to the base, wherein the multiple positioning rods are disposed annularly on the base and arranged apart from each other;
    - multiple fixing rings each respectively mounted on an end of a respective one of the positioning rods;
    - an upper fixing unit mounted around a top of the trunk;
  - a light string unit, a top of the light string unit mounted annularly on the upper fixing unit and having
    - multiple fixing ropes mounted on a bottom of the light string unit, wherein the fixing ropes are respectively mounted on the fixing rings;
- multiple metal stakes respectively mounted through the multiple fixing rings to respectively fix the positioning rods.

2. The pre-lit metal frame Christmas tree as claimed in claim 1, wherein the upper fixing unit has an annular fixing stand, and the top of the light string unit is mounted annularly on the annular fixing stand.

3. The pre-lit metal frame Christmas tree as claimed in claim 1, wherein the base of the umbrella shaped frame has
- multiple positioning units mounted annularly on the base and arranged apart from each other, and the multiple positioning rods respectively and pivotally connected to the multiple positioning units;
- a connecting tube mounted on the base and extending upwardly, a bottom of the trunk mounted around the connecting tube.

4. The pre-lit metal frame Christmas tree as claimed in claim 3, wherein a pivot angle between each one of the positioning rods and the trunk ranges from 0 degree to 100 degrees.

5. The pre-lit metal frame Christmas tree as claimed in claim 1, wherein the positioning rods are arranged at equiangular intervals.

6. The pre-lit metal frame Christmas tree as claimed in claim 1, wherein the trunk has multiple supporting tubes, the supporting tubes are sleeved around each other in sequence, and each two adjacent ones of the supporting tubes are mutually slidable and selectively mounted securely with each other by an elastic engaging unit.

7. The pre-lit metal frame Christmas tree as claimed in claim 1, wherein the trunk has multiple supporting tubes, each one of the supporting tubes has a large diameter end and a small diameter end, each two adjacent ones of the supporting tubes are sleeved around each other in a way that the large diameter end of one of the two supporting tubes is mounted around the small diameter end of the other supporting tube.

8. The pre-lit metal frame Christmas tree as claimed in claim 1, wherein the light string unit is a net lights.

9. The pre-lit metal frame Christmas tree as claimed in claim 1, wherein the light string unit is a curtain light string.

10. The pre-lit metal frame Christmas tree as claimed in claim 1, wherein a light source of the light string unit is incandescent lights or light emitting diode lights.

11. The pre-lit metal frame Christmas tree as claimed in claim 1, wherein the umbrella-shaped net light has multiple resilient elements, a number of the multiple resilient elements is equal to a number of the fixing rings, and each one of the resilient elements is connected between a respective one of the fixing rings and the corresponding fixing rope.

* * * * *